US005916121A

United States Patent [19]

Wassenhoven

[11] Patent Number: 5,916,121

[45] Date of Patent: Jun. 29, 1999

[54] SLIVER FEEDING DEVICE FOR AN OPEN-END SPINNING MACHINE

[75] Inventor: Heinz-Georg Wassenhoven, Moenchengladbach, Germany

[73] Assignee: W. Schlafhorst AG & Co., Moenchengladbach, Germany

[21] Appl. No.: 09/030,108

[22] Filed: Feb. 25, 1998

[30] Foreign Application Priority Data

Mar. 5, 1997 [DE] Germany ..... 197 08 944

[51] Int. Cl.[6] ..... D01H 7/89

[52] U.S. Cl. ..... 57/408; 57/412

[58] Field of Search ..... 57/400, 404, 406, 57/407, 408, 412

[56] References Cited

U.S. PATENT DOCUMENTS

| | | | |
|---|---|---|---|
| 4,098,065 | 7/1978 | Stahlecker et al. | 57/406 X |
| 4,769,984 | 9/1988 | Raasch et al. | 57/407 |
| 5,488,822 | 2/1996 | Meier | 57/406 X |
| 5,509,261 | 4/1996 | Wassenhoven et al. | 57/412 X |
| 5,600,945 | 2/1997 | Schmidke et al. | 57/412 X |

FOREIGN PATENT DOCUMENTS

| | | | |
|---|---|---|---|
| 3500511 | 8/1985 | Germany | 57/408 |
| 35 01 842 A1 | 7/1986 | Germany . | |
| 40 22 963 A1 | 1/1992 | Germany . | |
| 4022963 | 1/1992 | Germany | 57/412 |
| 40 24 474 A1 | 2/1992 | Germany . | |
| 41 26 552 A1 | 2/1993 | Germany . | |
| 43 23 213 A1 | 1/1995 | Germany . | |
| 195 39 629 A1 | 4/1997 | Germany . | |
| 197 08 944 | 6/1997 | Germany . | |

*Primary Examiner*—John J. Calvert
*Assistant Examiner*—Gina Silverio
*Attorney, Agent, or Firm*—Kennedy Covington Lobdell & Hickman, LLP

[57] ABSTRACT

A sliver feeding device for an open-ended spinning machine (1) wherein sliver is fed to the front of a spinning rotor (44) revolving at high speed in a rotor housing (2), with a pivotable cover element (11) for closing the rotor housing (2) having an integrated sliver opening device (13) with a lateral sliver feeding device embodied as a feeding trough/condenser unit (17). An inlet condenser (28) of this feeding trough/condenser unit (17) has an open sliver guide chute (37) terminating in a condenser funnel (36). The sliver guide chute extends at a rearward inclination around a convexly rounded core area (39) of the inlet condenser. A sliver loop opener (23) is disconnected and arranged at a distance from the cover element (11) so as not to be affected by its pivotal opening movement.

7 Claims, 4 Drawing Sheets

SLIVER FEEDING DEVICE FOR AN OPEN-END SPINNING MACHINE

FIELD OF THE INVENTION

The present invention relates generally to a sliver feeding device for an open-end spinning machine wherein sliver is fed at a front side thereof into a spinning rotor revolving at high speed in a rotor housing, and a pivotable cover element closes the rotor housing at the front and carries an integral sliver opening device with a lateral sliver feeding device having a loop opener, a sliver guide chute and a condensing funnel.

BACKGROUND OF THE INVENTION

Sliver feeding devices, which conduct a sliver stored in a spinning can to an open-end spinning machine, and in particular guide the sliver into a nip between a sliver draw-in cylinder and a connected feed trough, are known in various embodiments.

Customarily such sliver feeding devices have a sliver condenser with a sliver guide chute which is designed such that the sliver is securely guided over the entire area of the condenser and is gathered prior to entering the nip between the feed trough and the sliver draw-in cylinder such that all fibers always move underneath the nip and can be combed out by the opening roller.

An inlet condenser is described in German Patent Publication DE 35 01 842 A1, wherein the condenser body and the feeding trough constitute one component. This component is displaceably mounted on an eccentrically seated guide element arranged parallel with the axis of rotation of the draw-in roller. Thus, for threading the sliver, the condenser body can be moved together with the feeding trough out of the area of the draw-in roller, and after threading can be moved back into work position again. In the work position the component is arrested in a position in which the spring-biased feeding trough and the draw-in roller constitute a nip area for the sliver, with the outlet opening of the condenser body located in the immediate vicinity of the nip area. The inlet location of the sliver feeding device, i.e. the place where the sliver is threaded into the condenser, is embodied as an eyelet and has deflection edges for opening loops which may possibly form in the sliver.

Another inlet condenser is known from German Patent Publication DE 40 22 963 A1, and has a sliver guide conduit with a funnel-like condensing section and an inlet section, which laterally terminates in the condensing section and extends slanted. A diagonally arranged run-up incline forming an edge-like obstacle is provided in the transition area between the inlet section and the funnel-like condensing section. It is intended by means of the run-up incline to prevent folding of the flattened web-like sliver when entering the condensing section. With this sliver feeding device, an eyelet-like handle is also provided at the entry location for the sliver into the inlet condenser and extends around the sliver on all sides to open loops therein.

A sliver condenser is also known from the later published German Patent Publication DE 195 39 629.4, which has a sliver guide conduit with an inlet section and a funnel-like condensing section. The condensing section is oriented with its center longitudinal axis extending orthogonally with the sliver draw-in roller and has a sliver guide surface which makes a transition into the sliver guide surface of the inlet section without a change in the direction of the curvature. Furthermore, the inlet section of the sliver guide conduit is inclined at an angle in respect to a housing wall of the opening roller housing. With this sliver feeding device, the entry location at which the sliver enters the inlet condenser, is embodied as a closed inlet eye.

The above described sliver feeding devices have proven satisfactory in connection with open-end spinning machines in which both the seating of the rotor in the rotor housing and mounting of the sliver opening device within the associated sliver feeding device are fixed in a spinning box frame fastened to the machine frame. However, the known sliver feeding devices are disadvantageous if used in open-end spinning machines in which the sliver opening devices and therefore also the sliver feeding devices are integrated into or otherwise installed on pivotably seated cover elements, as described in German Patent Publication DE 43 23 213 A1.

With spinning units of such design, the sliver opening device together with the associated sliver feeding device is pivoted away to a front side when the spinning machine is opened, and in the process the sliver being delivered from the spinning can positioned underneath the spinning station into the inlet condenser is greatly stressed by buckling at the entry location into the condenser. This heavy mechanical stress of the sensitive sliver leads to fiber displacement inside the sliver, which subsequently can have a negative effect on the spinning result or can lead to an immediate sliver break.

SUMMARY OF THE INVENTION

In view of the known sliver feeding devices described above, it is accordingly an object of the present invention to create a sliver feeding device which can be advantageously employed in connection with an open-end spinning machines wherein the sliver opening device is integrated in a pivotably seated cover element.

This objective is substantially achieved by a sliver feeding device for use in an open-end spinning station which basically comprises a spinning rotor, a rotor housing open at a front side thereof for rotatably supporting the spinning rotor for high speeding spinning rotation, a pivotable cover element for closing and opening the rotor housing at the front side thereof, and a sliver opening device integrated with the cover element for pivotable movement therewith. In accordance with the present invention, the sliver opening device comprises a slider feeding device having an inlet condenser with an open convexly rounded sliver guide chute extending around a core area and a condenser funnel for receiving sliver from the guide chute. A sliver loop opener is arranged at a spacing from the sliver feeding device for passage of the sliver through the loop opener during delivery to the sliver feeding device, but the loop opener is disconnected from the cover element and from the sliver feeding device so as to be uninfluenced by pivotal movement of the cover element.

This embodiment in accordance with the present invention of the sliver feeding device with an inlet condenser having an open sliver guide chute terminating in a condensing funnel, as well as a loop opener, which is oriented to function in association with, but disconnected from, the inlet condenser, offers the advantage that damage of the sliver is dependably prevented, since during the opening of the cover element the sliver can slide out of the sliver guide chute, so that mechanical stress of the sliver, for example by buckling, is prevented.

In particular, the sliver opening device comprises an opening roller housing having a rear wall and the sliver guide chute is inclined with respect to the rear wall of the opening roller housing. By virtue of this inclined orientation of the sliver guide chute in conjunction with its open design, the sliver guide chute is enabled to release the sliver during opening of the cover element and, then, during the closing of the cover element to the open-end spinning station to cause sliver to automatically slide back into a defined, sliver running position within the chute.

The angle of inclination of the sliver guide chute preferably lies at an acute angle between 15 and 60 degrees, with an angle of inclination between 30 and 45 degrees being particularly advantageous to insure that the sliver is guided gently, i.e. almost without change in direction, during the spinning operation and, on the other hand, can slide without problems into and out of its running position in the sliver guide chute during pivoting movements of the cover element.

In a preferred embodiment of the sliver feeding device, the feeding trough holder is embodied as a one-piece, rugged component made of metal, on which the inlet condenser, which preferably is made of plastic, is mounted. Such an embodiment assures that there will be no mechanical stress on the inlet condenser, both during the spinning process and when introducing the sliver into the nip area between the feeding trough and the sliver draw-in cylinder, which has a positive effect on the stability and service life of the unit of feeding trough and condenser unit.

According to one aspect of the invention, the feeding trough holder has a lateral stop edge for positioning thereagainst of the inlet condenser, the stop edge preferably being at the outward, i.e., front, side of the feeding trough holder as viewed in the traveling direction of the sliver. This arrangement assures that the sliver is always fed in centered relation to the nip line between the feeding trough and the sliver draw-in cylinder, so that the sliver can always be evenly processed by the rotating opening roller.

Preferably, the loop opener is arranged stationarily in the area of a dirt removal device associated with the sliver opening device, which assures that, on the one hand, no sliver loops can reach the inlet condenser and, on the other hand, the sliver is not excessively stressed either in the open or the closed state of the open-end spinning station.

Further aspects, details and advantages of the invention will be described and understood from the exemplary embodiment explained below with reference to the accompanying drawings.

DETAILED DESCRIPTION OF THE PREFERRED EMBODIMENT

Figure 1:
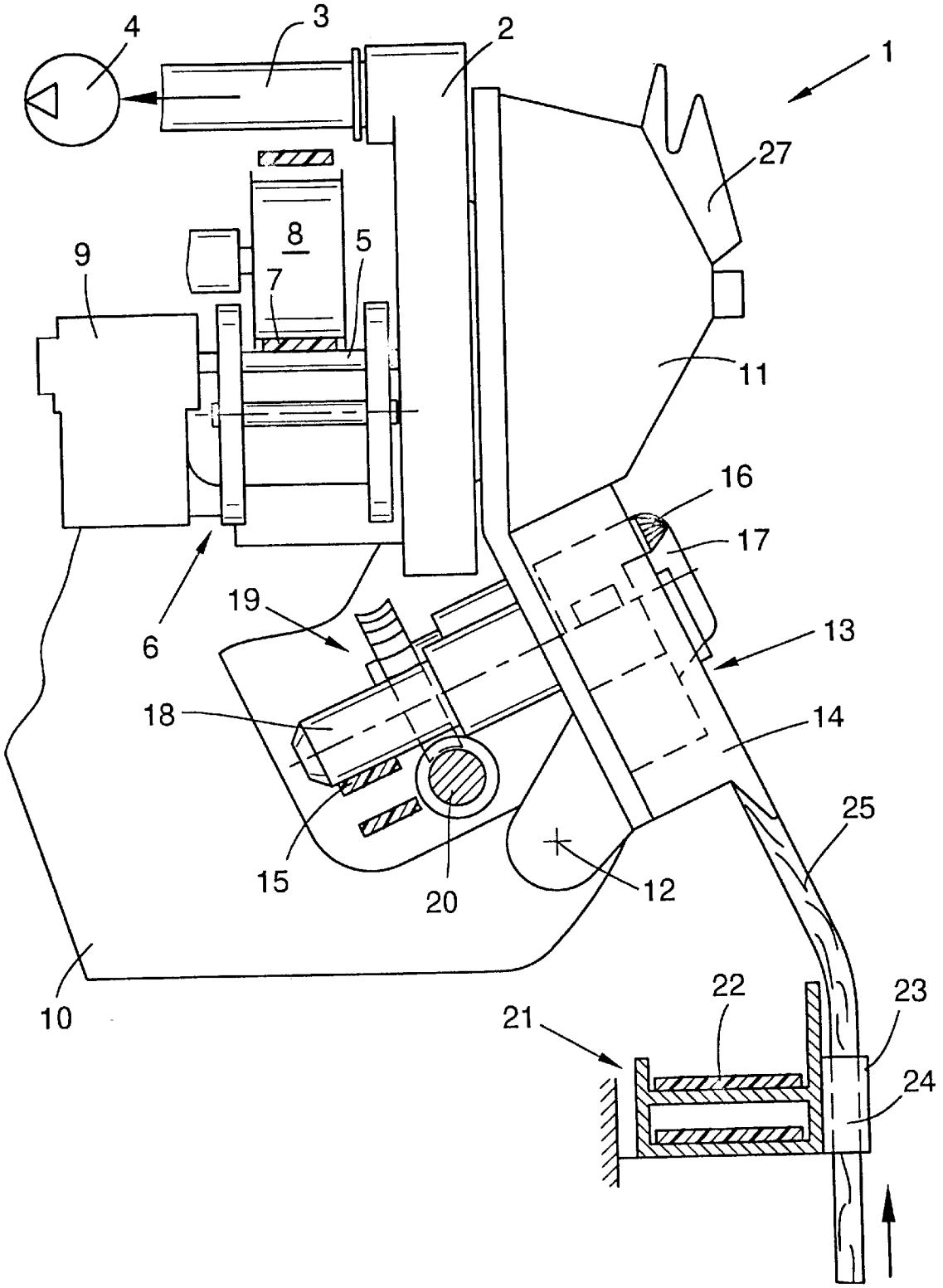
FIG. 1 is a side elevational view of one spinning station of an open-end spinning machine having a slider feeding device in accordance with the present invention, wherein a sliver opening device is integrated in a pivotably seated cover element which is shown in the closed, i.e. operating, state.

Referring now to the accompanying drawings, FIG. 1 shows one representative spinning station 1 of a multistation open-end rotor spinning machine in a lateral view. The spinning station 1 is in its operating state with its spinning rotor housing 2 closed by means of a cover element 11. Such open-end rotor spinning machines 1 are well known to have a cup-like spinning rotor 44 which rotates at a high rpm inside the rotor housing 2. In this case, the rotor housing 2 is connected to a vacuum source 4 by means of a pneumatic line 3. The spinning rotor 44 is fixed to a rotor shaft 5 which is supported in a wedge-like seat formed by pairs of disks in a support disk bearing 6 and is rotatably driven by means of a tangential belt 7 maintained in driving contact with the shaft 5 by a pressure roller 8. In the axial direction, the rotor shaft 5 is supported in an appropriate axial bearing 9. The rotor housing 2 as well as the bearing devices 8, 9 are fixed on a spinning box frame 10, which itself is connected with the spinning machine frame (not represented).

As already mentioned above the rotor housing 2 is open toward a front side of the spinning machine and is closed during the spinning operation by a conduit plate portion of the cover element 11, which is pivotably seated on the spinning box frame 10 around a pivot shaft 12. A sliver opening device 13 is integrated into the cover element and, as is customary, includes an opening roller 42 rotable in an opening roller housing 14, a sliver draw-in cylinder 16 and an associated sliver feeding device embodied in the present case as a feeding trough/condenser unit 17.

The opening roller 42 is mounted on a shaft 18 which is driven by a tangential belt 15 extending over the length of the spinning machine and in engagement against the opening roller shafts 18 of all spinning stations. The sliver draw-in cylinder 16 is driven in a known manner via a gear arrangement of a worm and a worm gear 19, with the worm fixed on a driveshaft 20 extending over the length of the spinning machine.

A dirt removal unit 21 is arranged underneath the opening roller housing 14 to receive soil, debris, dirt and other waste discharged from a dirt exit opening of the opening roller housing 14 and removes such waste, for example, by the mechanical means of a circulating dirt transport belt 22. A sliver loop opener 23 is fixedly arranged on the frame of this dirt removal unit 21 and has a guide bore 24 through which entering sliver 25 travels so as to be smoothed while running through the loop opener 23 in advance of subsequently entering the feed trough-condenser unit 17, disposed at a downstream distance.

Figure 2:
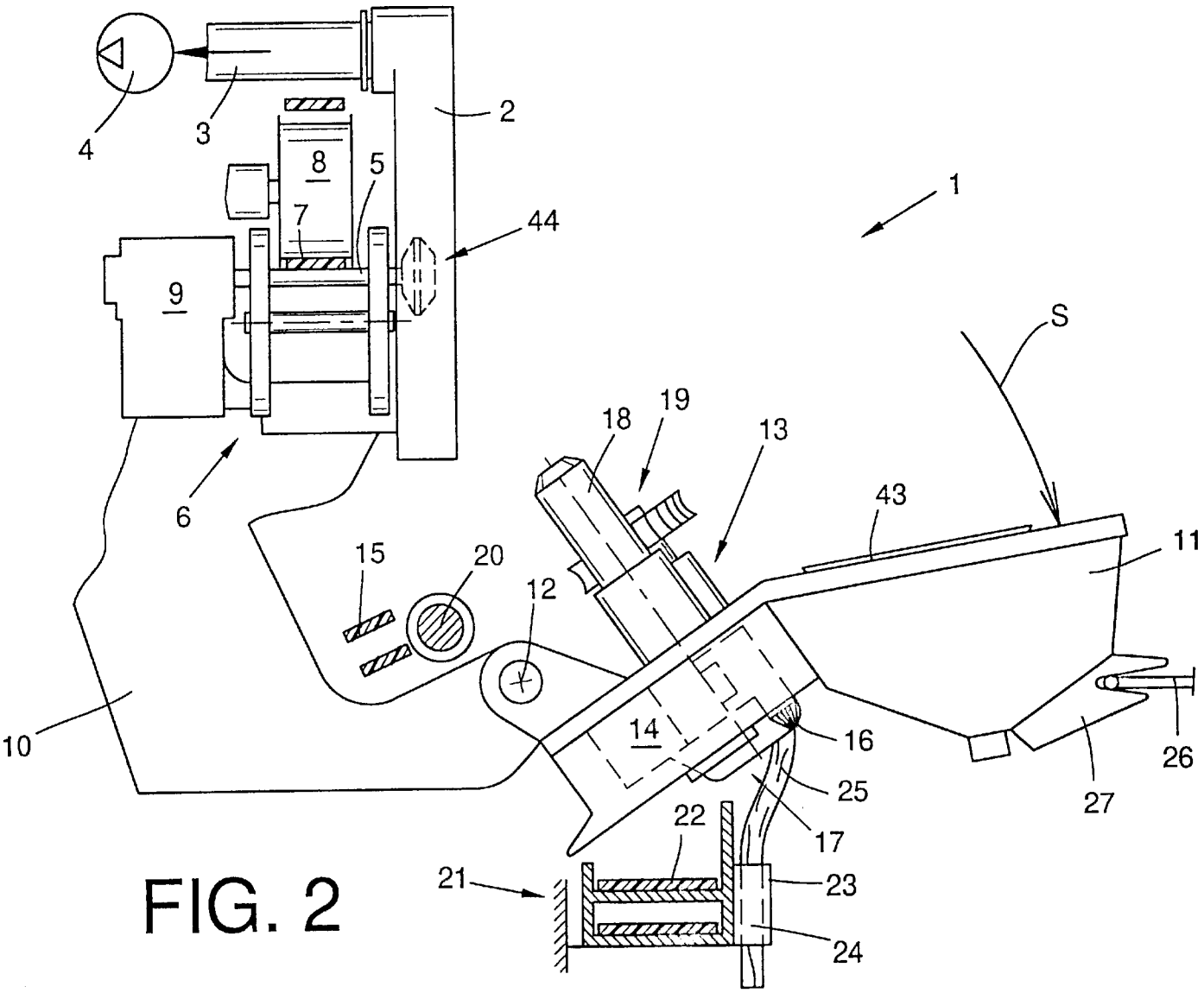
FIG. 2 is another side elevational view of the spinning station of FIG. 1 showing the cover element pivoted into an open position.

A maintenance operation on the open-end spinning station is represented in FIG. 2, i.e., the open-end spinning unit has been opened by a traveling maintenance unit (not represented), for example a piecing carriage, which is arranged to be moveable along the multiple spinning stations of the machine. To this end, the piercing carriage has a spinning box unlocking lever 26 which is engagable into an unlocking projection 27 on the cover element 11 and operates to pivot the cover element 11 in the direction S into the open position shown in FIG. 2. In this position, the forward opening into the rotor housing 2 is exposed and the rotor 44, indicated by dashed lines, is accessible from the front side of the machine. For purposes of maintenance and servicing operations, the rotor 44 is forcibly braked to a standstill by appropriate means which are not shown.

As can be seen in FIG. 2, the sliver 25 is not subjected to an additional change in direction even when the open-end spinning station is opened by such pivotal movement of the feeding trough/condenser unit 17 together with the cover element 11 from an operating position (FIG. 1) into a maintenance position (FIG. 2). Instead, during the pivoting movement of the cover element 11, the sliver can easily slide out of the completely open sliver guide chute 37 of the feeding trough/condenser unit 17.

Figure 3:
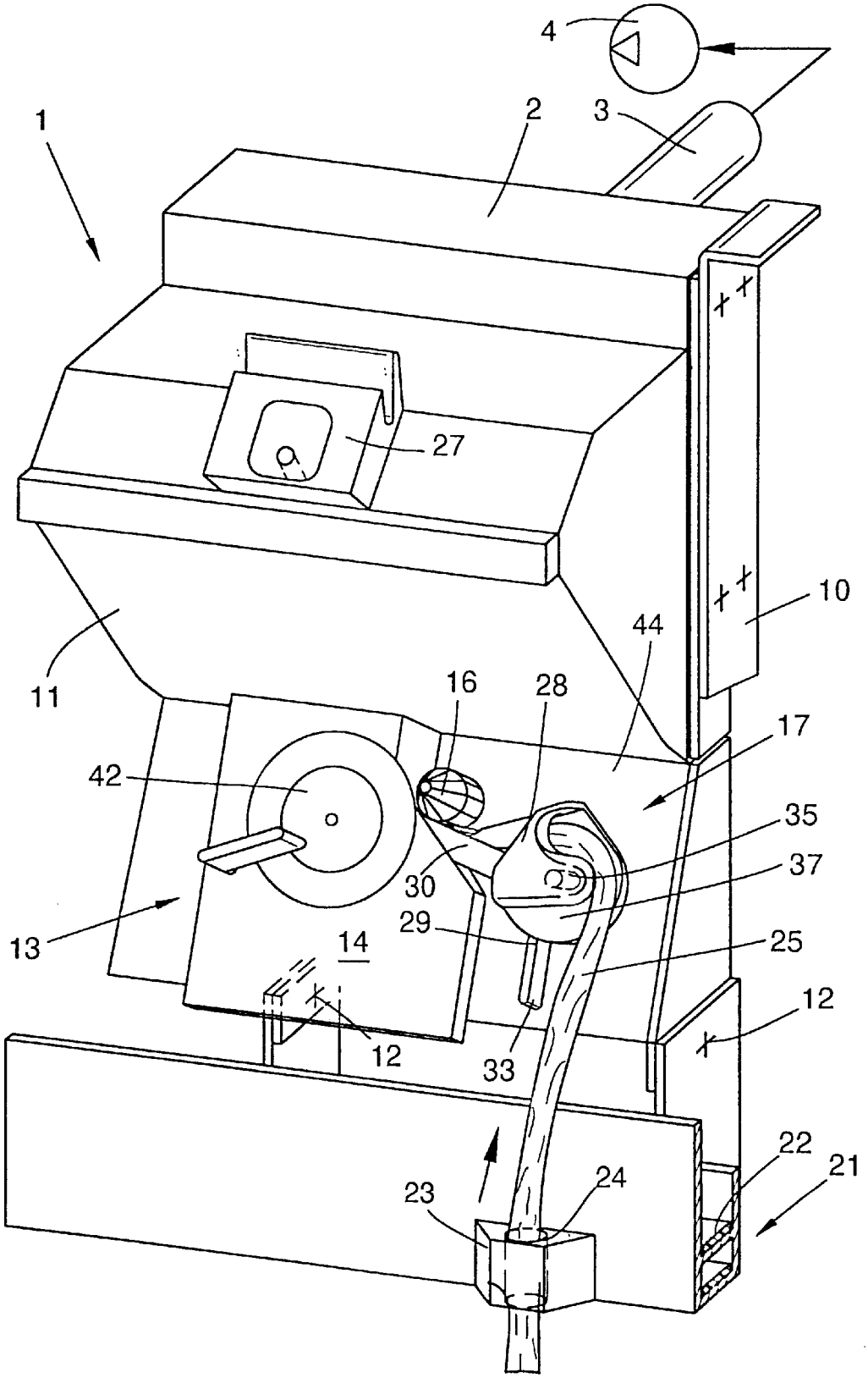
FIG. 3 is a perspective view of the open-end spinning station of FIGS. 1 and 2 with the sliver feeding device in accordance with the present invention.

As seen in the perspective view of FIG. 3, the same operating position of the components of the open-end spinning station is shown as in FIG. 1. It can be easily seen that in this operating position, the sliver 25 travels in the sliver guide chute 37 of the sliver feeding device of the present invention which serves to dependably and gently guide the sliver 25 into the nip between the sliver draw-in roller 16 and the feeding trough 17.

Figure 5:
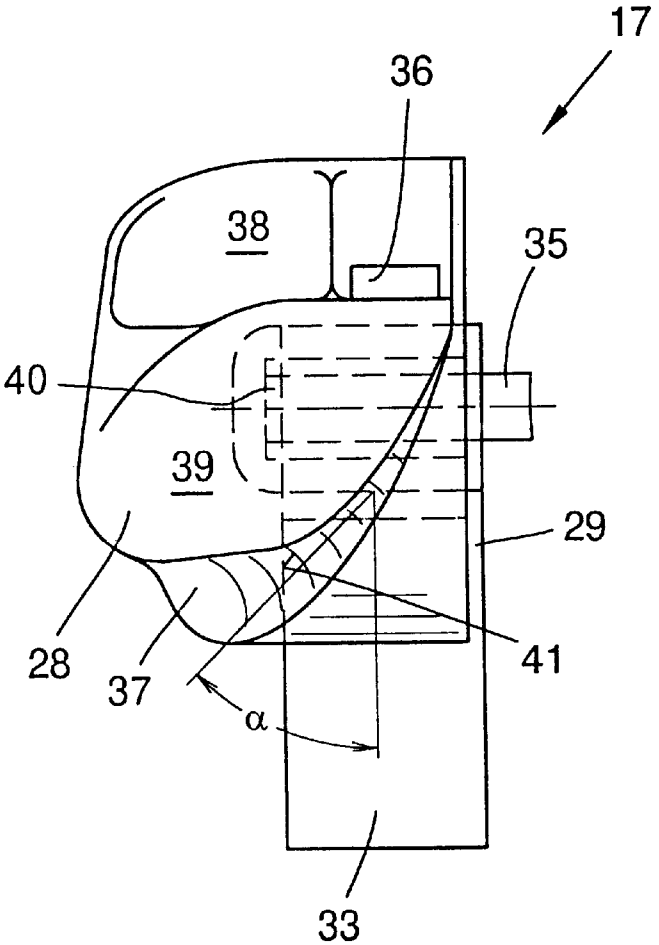
FIG. 5 is a side elevational view of the sliver feeding device of FIG. 4 as viewed in the direction of the arrow X thereof.
Figure 4:
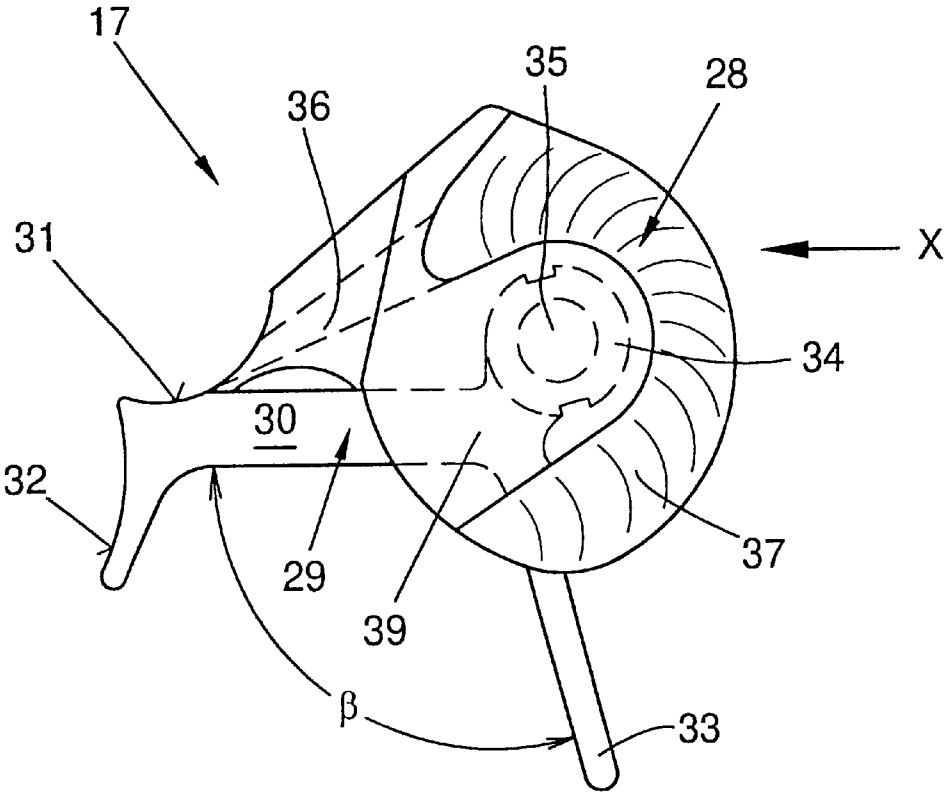
FIG. 4 is a front view of the sliver feeding device of FIGS. 1–3 embodied in accordance with the present invention as a feeding trough/condenser unit.

FIGS. 4 and 5 illustrate further the sliver feeding device in accordance with the present invention as embodied in the feeding trough-condenser unit 17. The feeding trough/condenser unit 17 essentially consists of two components, an inlet condenser 28 and a feeding trough holder 29.

The feeding trough holder 29 is configured in an L-shape, preferably embodied as a metal component, for example an extruded aluminum element. A feeding trough 31 is formed into one seating arm 30 of the feeding trough holder 29, which is followed by a tuft support 32. A pivot lever 33 is connected to the seating arm 30 at an angle of greater than 90 degrees. The feeding trough holder 29 additionally has a seating element 34, on which the inlet condenser 28 is seated to be fixed against relative rotation. The feeding trough holder 29 itself is disposed for a limited extent of movement on a seating bolt 35 and is maintained in contact with the sliver draw-in roller 16 by means of a spring element (not represented).

The actual inlet condenser 28 preferably is designed as an extruded plastic element and has an open sliver guide chute 37 leading to a condenser funnel 36. An inclined inlet element 38 is provided adjacent the condenser funnel 36, which in particular makes threading of the sliver 25 into the condensing funnel 36 easier. The center of the inlet condenser 28 is formed by a nose-like convexly rounded core area 39. A fastening bore 40 is formed in the interior of this core area 39 and is engaged by the seating bolt 35. The inlet condenser 28 also has a stop edge 41, which allows the positionally correct placement of the inlet condenser 28 on the feeding trough holder 29. As mounted on the feeding trough holder 29, the sliver guide chute 37 is inclined to a rearward lateral wall 43 of the opening roller housing 14 at an acute angle of between about 15 and 60 degrees, preferably in the range of about 30 to 45 degrees.

As a whole, the construction of the sliver feeding device in accordance with the present invention in the form of a feeding trough/condenser unit 17 with a separately arranged loop opener 23 represents a rugged, cost-effective component which can be advantageously employed, in particular in connection with open-end spinning machines having a pivotably seated cover element with an integrated sliver opening device.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A sliver feeding device for an open-end spinning station comprising a spinning rotor, a rotor housing open at a front side thereof for rotatably supporting the spinning rotor for high speed spinning rotation, a pivotable cover element for closing and opening the rotor housing at the front side thereof, a sliver opening device integrated with the cover element, the sliver opening device comprising a sliver feeding device having an inlet condenser with an open convexly rounded sliver guide chute extending around a core area and a condenser funnel for receiving sliver from the guide chute, and a sliver loop opener arranged at a spacing from the sliver feeding device and disconnected from the pivotal movement of the cover element.

2. The sliver feeding device in accordance with claim 1, wherein the sliver opening device comprises an opening roller housing having a rear wall and the sliver guide chute is inclined with respect to the rear wall of the opening roller housing.

3. The sliver feeding device in accordance with claim 2, wherein the sliver guide chute is oriented at an angle of inclination with respect to the rear wall between about 15 and 60 degrees.

4. The sliver feeding device in accordance with claim 2, wherein the sliver guide chute is oriented at an angle of inclination with respect to the rear wall between about 30 and 45 degrees.

5. The sliver feeding device in accordance with claim 1, wherein the sliver feeding device comprises a feeding trough holder having a seating arm formed with a feeding trough and a pivot lever, and means for supporting the inlet condenser on the feeding trough holder without mechanical stresses thereto during the insertion of the sliver.

6. The sliver feeding device in accordance with claim 5, wherein the feeding trough holder comprises a lateral stop edge for positioning thereagainst of the inlet condenser.

7. The sliver feeding device in accordance with claim 1, and further comprising a dirt removal device for receiving trash separated from the sliver by the sliver opening device, the loop opener being fixed on the dirt removal device.

* * * * *